US012291959B2

(12) United States Patent
Gissler

(10) Patent No.: US 12,291,959 B2
(45) Date of Patent: May 6, 2025

(54) POSITION SENSOR ASSEMBLY WITH CIRCUMFERENTIAL MAGNETIC COUPLING FOR WELLBORE OPERATIONS

(71) Applicant: Halliburton Energy Services, Inc., Houston, TX (US)

(72) Inventor: Robert Gissler, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 260 days.

(21) Appl. No.: 17/819,839

(22) Filed: Aug. 15, 2022

(65) Prior Publication Data

US 2024/0052741 A1 Feb. 15, 2024

(51) Int. Cl.
*E21B 47/092* (2012.01)
*E21B 34/12* (2006.01)

(52) U.S. Cl.
CPC ..... *E21B 47/092* (2020.05); *E21B 34/12* (2013.01)

(58) Field of Classification Search
CPC ..... E21B 47/092; E21B 34/12
See application file for complete search history.

(56) References Cited

U.S. PATENT DOCUMENTS

| | | | | |
|---|---|---|---|---|
| 5,589,769 | A * | 12/1996 | Krahn | G01D 5/145 324/207.21 |
| 5,666,050 | A | 9/1997 | Bouldin et al. | |
| 8,237,443 | B2 * | 8/2012 | Hopmann | E21B 47/092 324/306 |
| 11,098,818 | B2 | 8/2021 | Oulton | |
| 11,293,278 | B2 | 4/2022 | Joseph et al. | |
| 2012/0032099 | A1 * | 2/2012 | Vick, Jr. | F16K 31/086 251/65 |
| 2016/0208580 | A1 * | 7/2016 | Delzell | E21B 34/06 |
| 2021/0131220 | A1 * | 5/2021 | Gissler | E21B 34/06 |
| 2021/0131269 | A1 | 5/2021 | Joseph et al. | |
| 2021/0332669 | A1 | 10/2021 | Joseph et al. | |

FOREIGN PATENT DOCUMENTS

| | | | | |
|---|---|---|---|---|
| EP | 1967689 | A2 | 9/2008 | |
| JP | H11281308 | A | 10/1999 | |
| KR | 20040047244 | A | 6/2004 | |
| WO | WO-9817974 | A1 * | 4/1998 | G01D 5/06 |
| WO | 03093682 | A1 | 11/2003 | |
| WO | 2007084132 | A1 | 7/2007 | |
| WO | 2009038579 | A2 | 3/2009 | |
| WO | 2009038591 | A1 | 3/2009 | |

OTHER PUBLICATIONS

International Patent Application No. PCT/US2022/075041, International Search Report and Written Opinion mailed May 9, 2023, 12 pages.

* cited by examiner

*Primary Examiner* — George S Gray
(74) *Attorney, Agent, or Firm* — Kilpatrick Townsend & Stockton, LLP

(57) ABSTRACT

A downhole tool can include a position sensor comprising a first set of magnets and an internal slider. The downhole tool can also include a valve magnet assembly comprising a second set of magnets magnetically couplable to the first set of magnets. The second set of magnets can be positionable circumferentially around an outer diameter of the position sensor. The valve magnet assembly can be configured to move in response to a fluid valve. The valve magnet assembly can be configured to cause the internal slider of the position sensor to move in response to movement of the valve magnet assembly.

19 Claims, 8 Drawing Sheets

POSITION SENSOR ASSEMBLY WITH CIRCUMFERENTIAL MAGNETIC COUPLING FOR WELLBORE OPERATIONS

TECHNICAL FIELD

The present disclosure relates generally to wellbore operations and, more particularly (although not necessarily exclusively), to position sensors for wellbore operations.

BACKGROUND

A wellbore can be a hole that can be drilled into a subterranean formation. After the wellbore has been drilled, the wellbore can be completed to extract natural resources, such as oil, gas, or water from the wellbore. Completing the wellbore can involve running production tubing, electrical lines, and downhole tools into the wellbore. The wellbore may contain one or more downhole fluids, such as water, drilling fluid, formation fluid, oil, mud, or brine. Once the wellbore is complete, a production operation can be performed to retrieve the downhole fluids from the wellbore through valves in a completion string. Fluids may also be injected in the wellbore through one or more valves in the completion string to enhance fluid production through other valves in the completion string.

DETAILED DESCRIPTION

Figure 1:
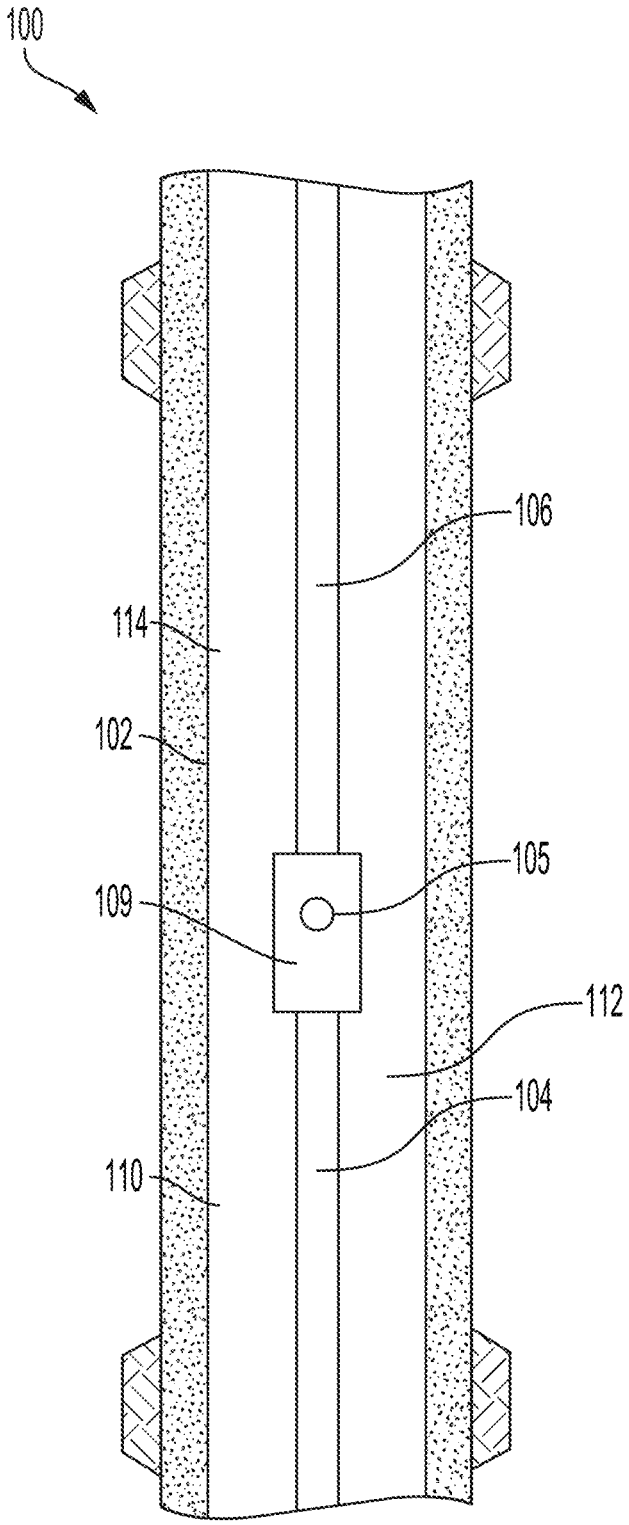
FIG. 1 is a sectional view of a well system containing a wellbore that includes a position sensor according to some examples of the present disclosure.

Certain aspects and examples of the present disclosure relate to a downhole tool for wellbore operations that includes position sensor assembly that has a valve magnet assembly circumferentially arranged around and magnetically coupled to a position sensor. The valve magnet assembly can be coupled to a fluid valve of the downhole tool. The fluid valve can be opened and closed to control an amount of fluid produced from a wellbore. Movement of the fluid valve can subsequently cause movement of the valve magnet assembly. And, due to the magnetic coupling of the valve magnet assembly and the position sensor, the movement of the valve magnet assembly can cause movement of an internal slider of the position sensor. As a result, the position sensor can monitor a position of the fluid valve, and thus an amount of fluid being produced.

Accurate determination of an amount that the fluid valve is opened within a hydrocarbon well system may be beneficial since fluid flow through the fluid valve can impact a development and production of the wellbore. When the fluid valve position is set to allow a larger or smaller flow of fluid than intended, the development and production of the hydrocarbon well system can be negatively impacted. Conventionally, a valve magnetic assembly and a position sensor are coupled to the fluid valve, and as the fluid valve opens and closes, the valve magnet assembly moves linearly. The position sensor also moves proportionally with the valve magnet assembly and indicates the amount the fluid valve is opened. But, magnets of the position sensor may not be efficiently coupled with magnets of the valve magnet assembly, so there can be a delay in movement of the position sensor. The delay can occur in various movements of the fluid valve, such as when movement of the fluid valve changes direction. For example, the delay may occur when the fluid valve changes from opening the fluid valve to partially closing the fluid valve. The delay in the movement of the position sensor can result in an incorrect position indication that indicates an incorrect amount that the fluid valve is opened. The delay can be at least partially attributed to magnetic hysteresis and friction.

Aspects of the present disclosure provide a valve assembly circumferentially arranged with a position sensor to reduce magnetic hysteresis of the magnetic coupling and improve the efficiency of that magnetic coupling. As a result, accuracy of the position sensor that relies on the magnetic coupling can be improved. The circumferential positioning of a magnet set of the valve magnet assembly around a magnet set of the position sensor can reduce a gap between the sets of magnets, increase a number of magnetic flux lines that can act on the magnet set of the position sensor, and increase a magnetic flux density that acts on the magnet set of the position sensor. So, there can be a higher coupling force that reduces a lag time between initial movement of the magnet set of the valve magnet assembly and initial movement of the magnet set of the position sensor. In addition, time and costs can be improved since steps typically taken to eliminate magnetic hysteresis can be reduced.

In some examples, a system includes an annulus-shaped valve magnet assembly. The valve magnet assembly can be installed around an outer diameter of a position sensor. The valve magnet assembly may be free to move along a length of the outer diameter of the position sensor. Movement of the valve magnet assembly can be tied to movement of a fluid valve, such as an interval control valve, using a slider that can engage a mandrel subassembly that moves within or along the fluid valve. The valve magnet assembly can include at least one set of magnets and flux spacers that are circumferentially distributed around the valve magnet assembly. Each set of magnets and flux spacers can contribute to a magnetic force that acts on a set of magnets of the position sensor. The number of sets of magnets and flux spacers can be changed to increase or decrease the magnet force. When the valve magnet assembly includes multiple sets of magnets, the magnets can be positioned within discreet holes machined in a housing of the valve magnet assembly. The housing material that is left between the holes for the magnets can provide additional housing support. So, the valve magnet assembly can accommodate higher pressures. Alternatively, when the valve magnet assembly includes a single set of magnets and flux spacers, the set may be positioned within a hollow cylinder of a housing of the valve magnet assembly. The single set can produce a fixed magnet force that acts on the magnet set of the position sensor.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a well system 100 containing a wellbore 102 that includes a position sensor according to some examples of the present disclosure. In some examples, the wellbore 102 can be cased and cemented, as shown in FIG. 1. In other examples, the wellbore 102 can be uncased or the casing may not be cemented. The wellbore 102 can include a data or power cable 104, for example, as part of a downhole completion string (not shown). The data or power cable 104 can be positioned in a downhole portion 112 of the wellbore 102 relative to a downhole tool 109. In some examples, the power cable 104 can be positioned in an annulus 110 between the downhole completion string and a wall of the wellbore 102. The wellbore 102 can further include a tubular string 106, for example, an uphole completion string. The tubular string 106 can be positioned in an uphole portion 114 of the wellbore 102 with respect to the downhole tool 109.

The downhole tool 109 can include a fluid valve 105 for controlling an amount of fluid production from the wellbore 102 or an amount of fluid injection from a valve in the downhole completion string. A position of the fluid valve 105 can be set to control the fluid production. The downhole tool 109 can also include a position sensor for detecting the position of the fluid valve 105 to determine whether the position is to be adjusted to achieve a desired fluid production from the wellbore 102.

Figure 2:
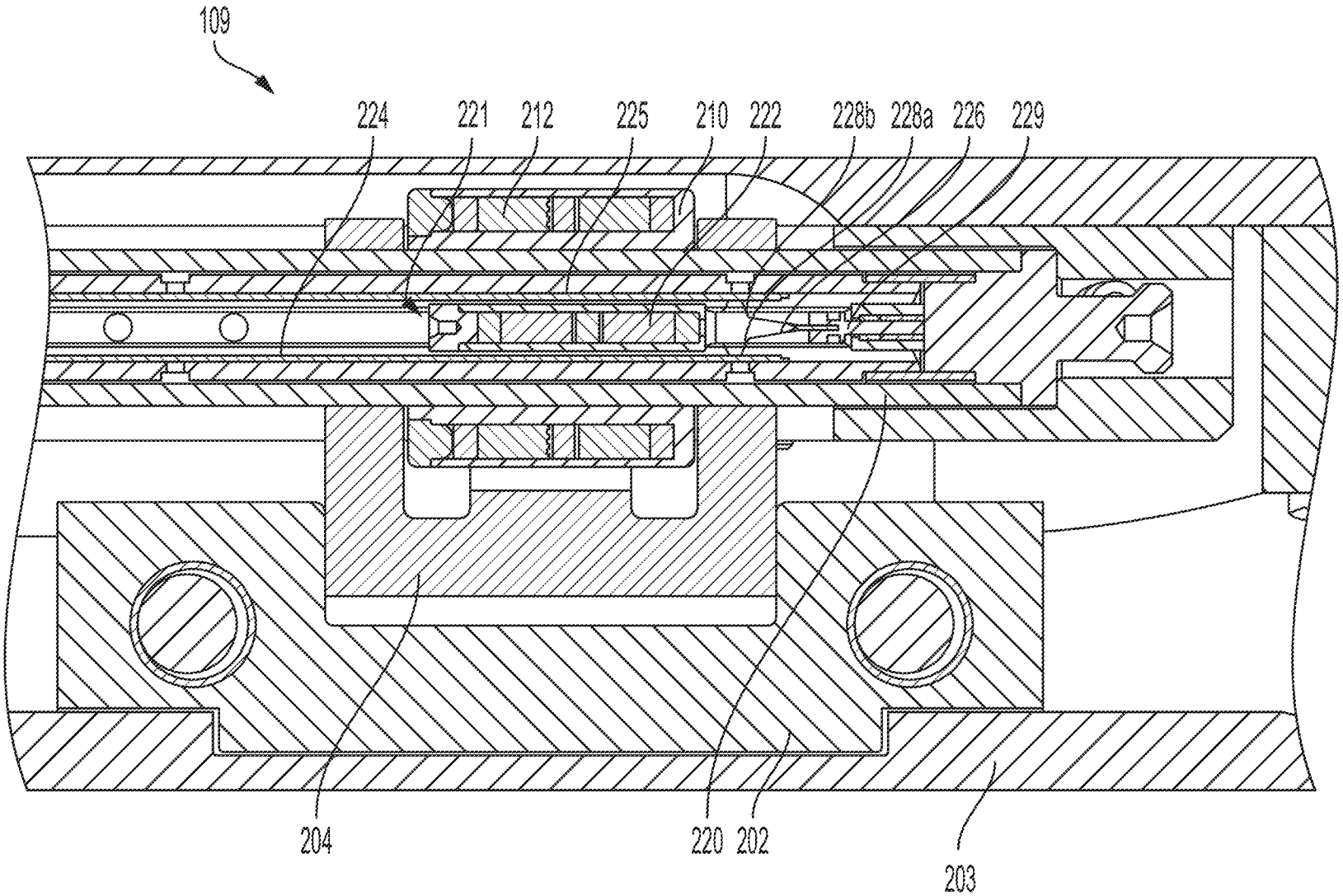
FIG. 2 is a sectional side-view of a downhole tool containing a position sensor assembly according to some examples of the present disclosure.

FIG. 2 is a sectional side-view of a downhole tool 109 containing a position sensor assembly according to some examples of the present disclosure. The downhole tool 109 can be deployed downhole in a wellbore (e.g., wellbore 102 in FIG. 1) during a production operation. The position sensor assembly can include a position sensor 220 positioned within a valve magnet assembly 210. Each of the position sensor 220 and the valve magnet assembly can include a set of magnets. For example, the valve magnet assembly 210 can include a set of magnets 212 and the position sensor 220 can include a set of magnets 222. The set of magnets 212 and the set of magnets 222 can be magnetically coupled to each other. So, movement of the set of magnets 212 can cause movement of the set of magnets 222.

The valve magnet assembly 210 can be coupled to a fluid valve (e.g., fluid valve 105 in FIG. 1) via a bracket 202 and a slider 204. That is, the fluid valve that controls an amount of production fluid produced from a wellbore can be coupled to the bracket 202 such that adjusting a position of the fluid valve by opening or closing the fluid valve causes movement of the bracket 202. The bracket 202 may be coupled to the fluid valve via a mandrel 203 of the downhole tool 109. The slider 204 can be positioned within a cut-out of the bracket 202 so that the movement of the mandrel 203 causes similar movement of the slider 204. Since the slider 204 is coupled to the valve magnet assembly 210, the movement of the slider 204 can in turn result in movement of the valve magnet assembly 210. And then, due to the magnetic coupling of the set of magnets 212 of the valve magnet assembly 210 and the set of magnets 222 of the position sensor 220, an internal slider 221 of the position sensor 220 can move as a result of the movement of the valve magnet assembly 210. Thus, the position sensor 220 can detect the position of the fluid valve. The set of magnets 222 may be part of the internal slider 221. The movement of the mandrel 203, the bracket 202, the slider, 204, the valve magnet assembly 210, and the internal slider 221 may be linear. Since the set of magnets 222 are circumferentially positioned around the set of magnets 212, the movement of the set of magnets 222 can accurately correlate with movement of the set of magnets 212 so that an accurate position of the fluid valve is detected.

In some examples, the position sensor 220 can include a resistive element 224, a conductive element 225, a contact 226, and a center conductor 229. The contact 226 can include at least one finger 228 that contacts the resistive element 224. As illustrated in FIG. 2, the contact 226 includes two fingers 228*a-b*. A first finger 228*a* contacts the resistive element 224 and a second finger 228*b* contacts the conductive element 225. Power can be provided into the resistive element 224, then into the first finger 228*a*, into the center conductor 229, into the second finger 228*b*, and then into the conductive element 225. The conductive element 225 can be a ground path for the current. As the slider 204 moves, such as to the left, in response to movement of the fluid valve, the first finger 228*a* moves to the left along the resistive element 224 while the resistance values change along the length of the resistive element 224. So, a change between a first resistance value at a first position of the first finger 228*a* and a second resistance value at a second position of the first finger 228*a* can correspond to a known change in position of the fluid valve. As a particular example, where the first position of the first finger 228*a* may have a resistance value of 9000 Ohms, and moving to the left an inch may have a resistance value of 8000 Ohms. So, a change in 1000 Ohms can directly relate to a one-inch change in position of the fluid valve. The resistance values may be read by surface equipment at a surface of the wellbore.

Figure 3:
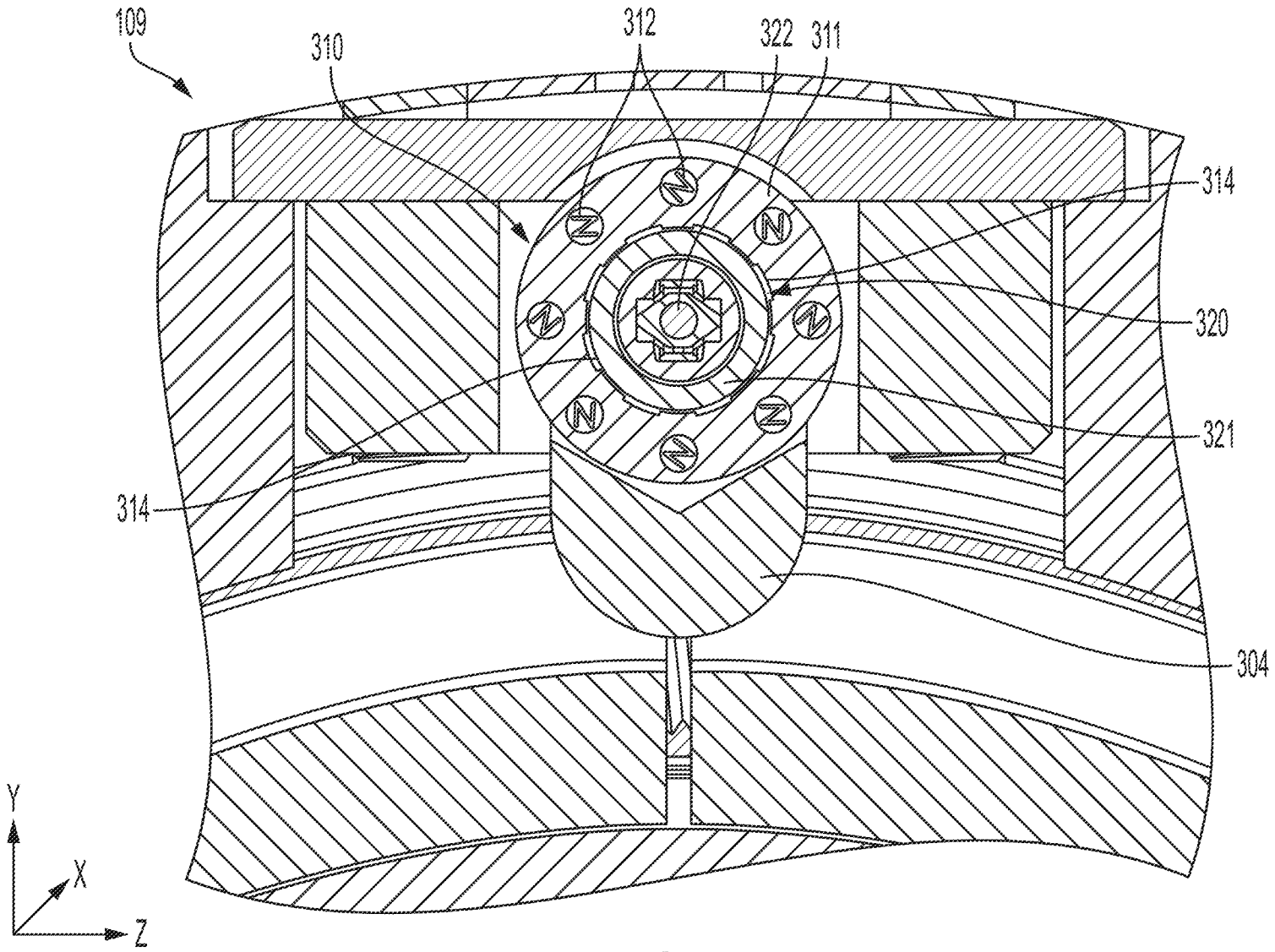
FIG. 3 is a sectional front-view of an example of a downhole tool containing a position sensor assembly with a valve magnet assembly having multiple circumferential magnets according to some examples of the present disclosure.

FIG. 3 is a sectional front-view of an example of a downhole tool 109 containing a position sensor assembly with a valve magnet assembly 310 having multiple circumferential magnets according to some examples of the present disclosure. The position sensor assembly can include a position sensor 320 having a housing 321 in which a set of magnets 322 is positioned. The set of magnets 322 may include one or more magnets.

The downhole tool 109 can include a valve magnet assembly 310 positioned around an outer diameter of the housing 321 of the position sensor 320. The valve magnet assembly 310 can include a housing 311 in which a set of magnets 312 is positioned. The set of magnets 312 can be magnetically coupled to the set of magnets 322. As illustrated in FIG. 3, the set of magnets 312 can include eight subsets of magnets distributed circumferentially around the outer diameter of the housing 321 of the position sensor 320. In addition, the housing 311 can include one or more slots 314 to increase a tolerance between the housing 311 and the housing 321. As such, if debris is trapped between the position sensor 320 and the valve magnet assembly 310, the valve magnet assembly 310 may not be impeded from moving relative to the position sensor 320.

The housing 311 of the valve magnet assembly 310 can be coupled to a slider 304 that can be coupled to a fluid valve (e.g., fluid valve 105 in FIG. 1). So, as a position of the fluid valve is adjusted, the slider 304 can be moved (e.g., in an X-direction), which causes the valve magnet assembly 310 to also be moved. Movement of the valve magnet assembly 310 can result in movement of an internal slider (e.g., internal slider 221 in FIG. 2) of the position sensor 320 due to the magnetic coupling of the set of magnets 312 and the set of magnets 322. The housing 311 and the housing 321 may be made of Inconel 718, MP35N, or any other suitable material for handling downhole pressures and conditions. Coatings may additionally be added to reduce friction and wear. The slider 304 may be made of polyetheretherketone (PEEK), or any other suitable material or combination of materials.

In some examples, the set of magnets 322 of the position sensor 320 can include at least a first magnet having a first pole axis. In addition, the set of magnets 312 of the valve magnet assembly 310 can include at least a second magnet having a second pole axis. The first pole axis and the second pole axis can be aligned. For example, the first pole axis and the second pole axis can both be in an X-direction. Alternatively, the first pole axis of the set of magnets 322 of the position sensor 320 can be perpendicular to the second pole axis of the set of magnets 312 of the valve magnet assembly 310. For example, the first pole axis can be in a Y-direction and the second pole axis can be in the X-direction.

A pole of the set of magnets 312 may be aligned with an opposite pole of the set of magnets 322. For example, a north pole of the set of magnets 312 can be aligned with a south pole of the set of magnets 322. So, magnetic flux lines can extend between each magnet of the set of magnets 312 and the set of magnets 322 to act on the set of magnets 322 to cause movement of the internal slider of the position sensor 320.

Figure 4:
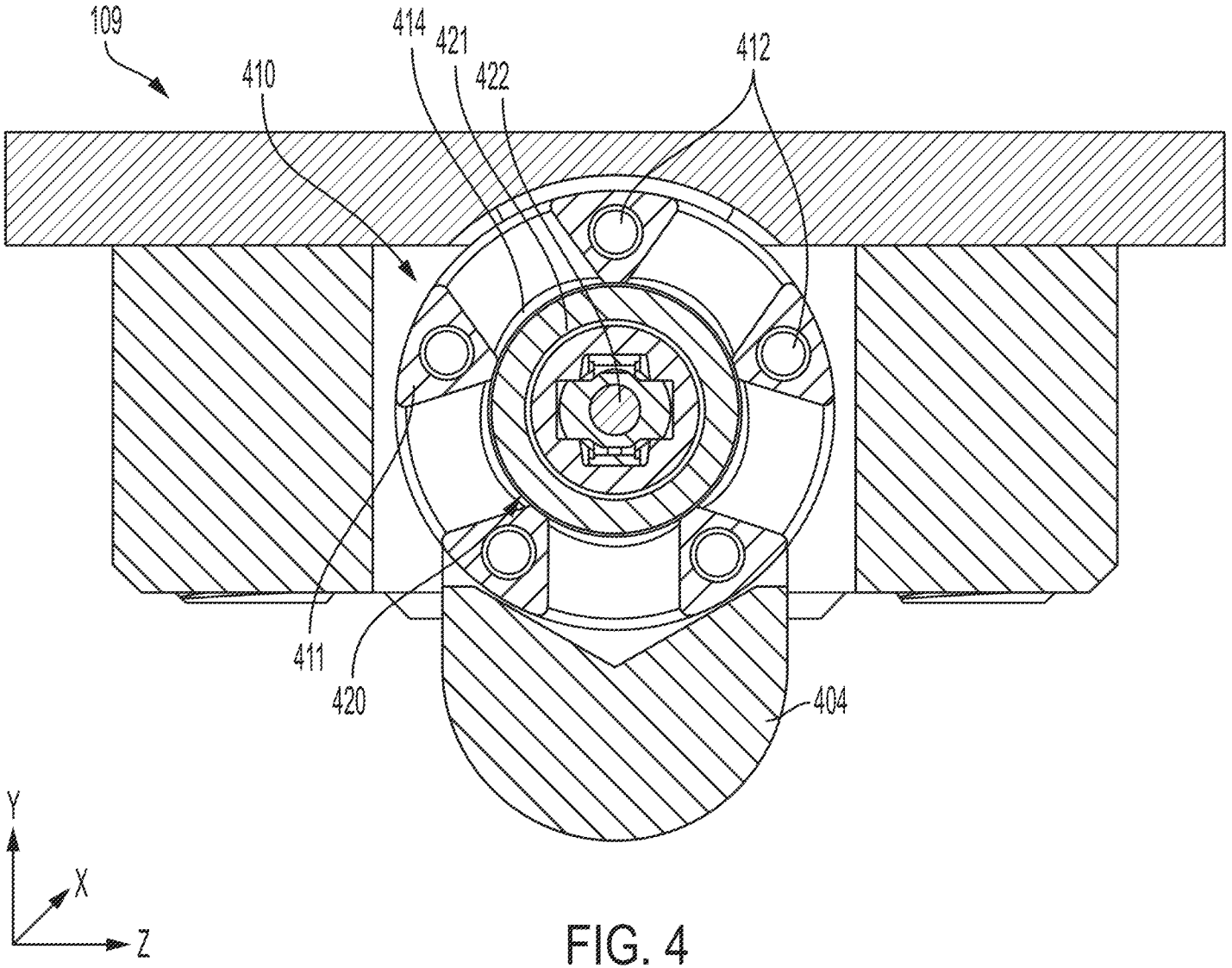
FIG. 4 is a sectional front-view of another example of a downhole tool containing a position sensor assembly with a valve magnet assembly having multiple circumferential magnets according to some examples of the present disclosure.

FIG. 4 is a sectional front-view of another example of a downhole tool 109 containing a position sensor assembly with a valve magnet assembly 410 having multiple circumferential magnets according to some examples of the present disclosure. The position sensor assembly can include a position sensor 420 with a housing 421 in which a set of magnets 422 is positioned. The set of magnets 422 may include one or more magnets.

The downhole tool 109 can include a valve magnet assembly 410 positioned around an outer diameter of the housing 421 of the position sensor 420. The valve magnet assembly 410 can include a housing 411 in which a set of magnets 412 is positioned. The set of magnets 412 can be magnetically coupled to the set of magnets 422. As illustrated in FIG. 4, the set of magnets 412 can include five subsets of magnets distributed circumferentially around the outer diameter of the housing 421 of the position sensor 420. In addition, the housing 411 can include one or more slots 414 to increase a tolerance between the housing 411 and the housing 421. As such, if debris is trapped between the position sensor 420 and the valve magnet assembly 410, the valve magnet assembly 310 may not be impeded from moving relative to the position sensor 320.

The housing 411 of the valve magnet assembly 410 can be coupled to a slider 404 that can be coupled to a fluid valve (e.g., fluid valve 105 in FIG. 1). So, as a position of the fluid valve is adjusted, the slider 404 can be moved (e.g., in an X-direction), which causes the valve magnet assembly 410 to also be moved. Movement of the valve magnet assembly 410 can result in movement of an internal slide (e.g., internal slider 221 in FIG. 2) the position sensor 420 due to the magnetic coupling of the set of magnets 412 and the set of magnets 422. The housing 411 and the housing 421 may be made of Inconel 718, MP35N, or any other suitable material for handling downhole pressures and conditions. Coatings may additionally be added to reduce friction and wear. The slider 404 may be made of PEEK, or any other suitable material or combination of materials.

In some examples, the set of magnets 422 of the position sensor 420 can include at least a first magnet having a first pole axis. In addition, the set of magnets 412 of the valve magnet assembly 410 can include at least a second magnet having a second pole axis. The first pole axis and the second pole axis can be aligned. For example, the first pole axis and the second pole axis can both be in an X-direction. Alternatively, the first pole axis of the set of magnets 422 of the position sensor 420 can be perpendicular to the second pole axis of the set of magnets 412 of the valve magnet assembly 410. For example, the first pole axis can be in a Y-direction and the second pole axis can be in the X-direction.

A pole of the set of magnets 412 may be aligned with an opposite pole of the set of magnets 422. For example, a north pole of the set of magnets 412 can be aligned with a south pole of the set of magnets 422. So, magnetic flux lines can extend between each magnet of the set of magnets 412 and the set of magnets 422 to act on the set of magnets 422 to cause movement of the internal slider. In FIG. 3, magnetic flux lines may directly interact and repel each other for magnets of the set of magnets 312 that are opposite each other in the housing 311. But, since FIG. 4 includes an odd number of subsets of magnets that are not directly across from each other in the housing 411, there may be less opposition between magnetic flux lines. As a result, there may be an increased magnetic flux density for moving the position sensor 420 in response to movement of the valve magnet assembly 410.

Figure 5:
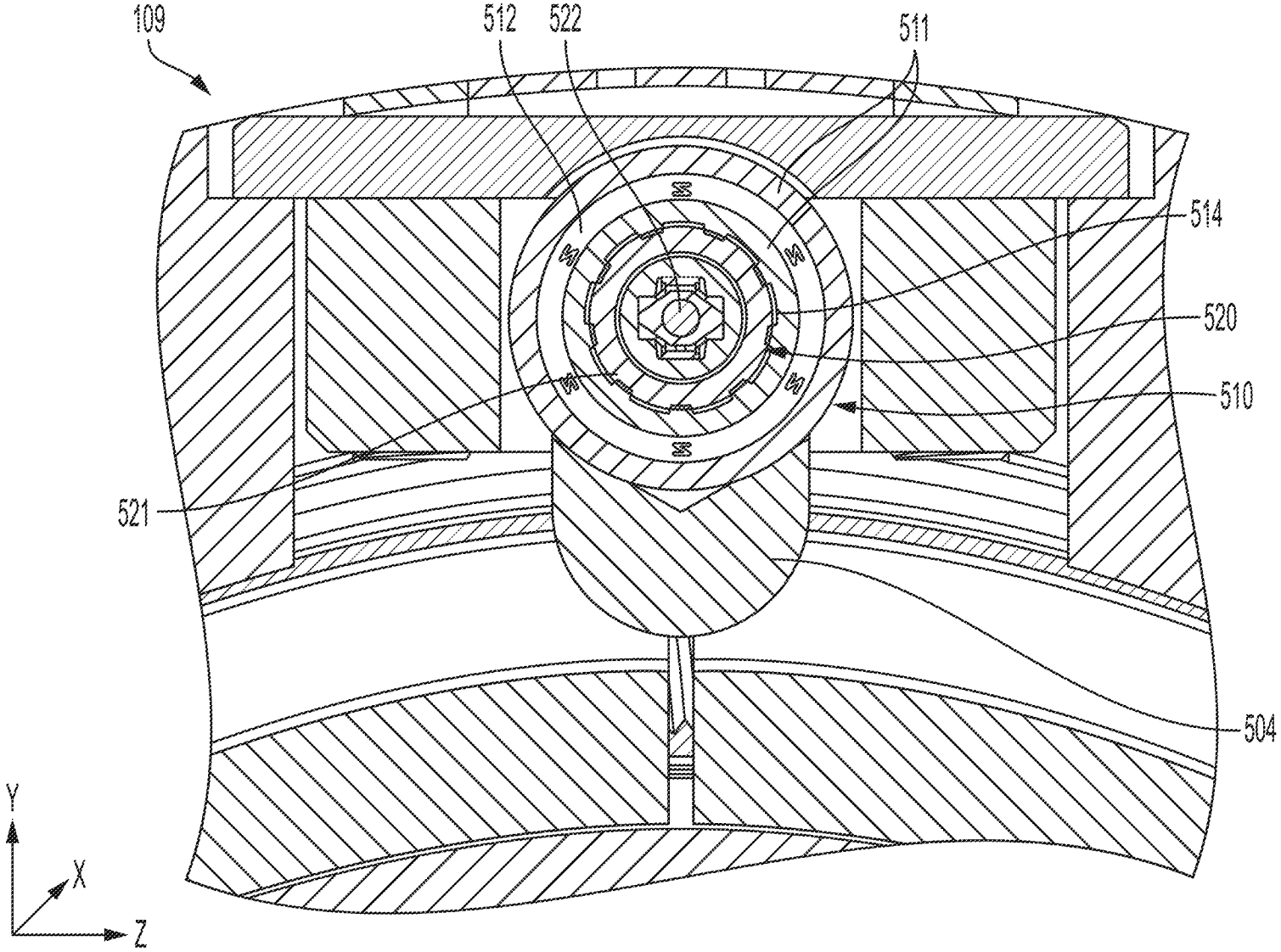
FIG. 5 is a sectional front-view of an example of a downhole tool containing a position sensor assembly with a valve magnet assembly having a single circumferential magnet according to some examples of the present disclosure.

FIG. 5 is a sectional front-view of an example of a downhole tool 109 containing a position sensor assembly having a valve magnet assembly 510 with a single circumferential magnet according to some examples of the present disclosure. The position sensor assembly can include a position sensor 520 having a housing 521 in which a set of magnets 522 is positioned. The set of magnets 522 may include one or more magnets.

The downhole tool 109 can include a valve magnet assembly 510 positioned around an outer diameter of the housing 521 of the position sensor 520. The valve magnet assembly 510 can include a housing 511 in which a set of magnets 512 is positioned. The set of magnets 512 can be magnetically coupled to the set of magnets 522. As illustrated in FIG. 5, the set of magnets 512 can include one subset of magnets that is circumferentially positioned around an entirety of the outer diameter of the housing 521 of the position sensor 520. The set of magnets 512 can be embedded within the housing 511. In addition, the housing 511 can include one or more slots 514 to increase a tolerance between the housing 511 and the housing 521. As such, if debris is trapped between the position sensor 520 and the valve magnet assembly 510, the valve magnet assembly 510 may not be impeded from moving relative to the position sensor 520.

The housing 511 of the valve magnet assembly 510 can be coupled to a slider 504 that can be coupled to a fluid valve (e.g., fluid valve 105 in FIG. 1). So, as a position of the fluid valve is adjusted, the slider 504 can be moved (e.g., in an X-direction), which causes the valve magnet assembly 510 to also be moved. Movement of the valve magnet assembly 510 can result in movement of the an internal slider (e.g., internal slider 221 in FIG. 2) of the position sensor 520 due to the magnetic coupling of the set of magnets 512 and the set of magnets 522. The housing 511 and the housing 521 may be made of Inconel 718, MP35N, or any other suitable material for handling downhole pressures and conditions. Coatings may additionally be added to reduce friction and wear. The slider 504 may be made of PEEK, or any other suitable material or combination of materials.

In some examples, the set of magnets 522 of the position sensor 520 can include at least a first magnet having a first pole axis. In addition, the set of magnets 512 of the valve magnet assembly 510 can include at least a second magnet having a second pole axis. The first pole axis and the second pole axis can be aligned. For example, the first pole axis and the second pole axis can both be in an X-direction. Alternatively, the first pole axis of the set of magnets 522 of the position sensor 520 can be perpendicular to the second pole axis of the set of magnets 512 of the valve magnet assembly 510. For example, the first pole axis can be in a Y-direction and the second pole axis can be in the X-direction.

A pole of the set of magnets 512 may be aligned with an opposite pole of the set of magnets 522. For example, a north pole of the set of magnets 512 can be aligned with a south pole of the set of magnets 522. So, magnetic flux lines can extend between each magnet of the set of magnets 512 and the set of magnets 522 to act on the set of magnets 522 to cause movement of the position sensor 520.

Figure 6:
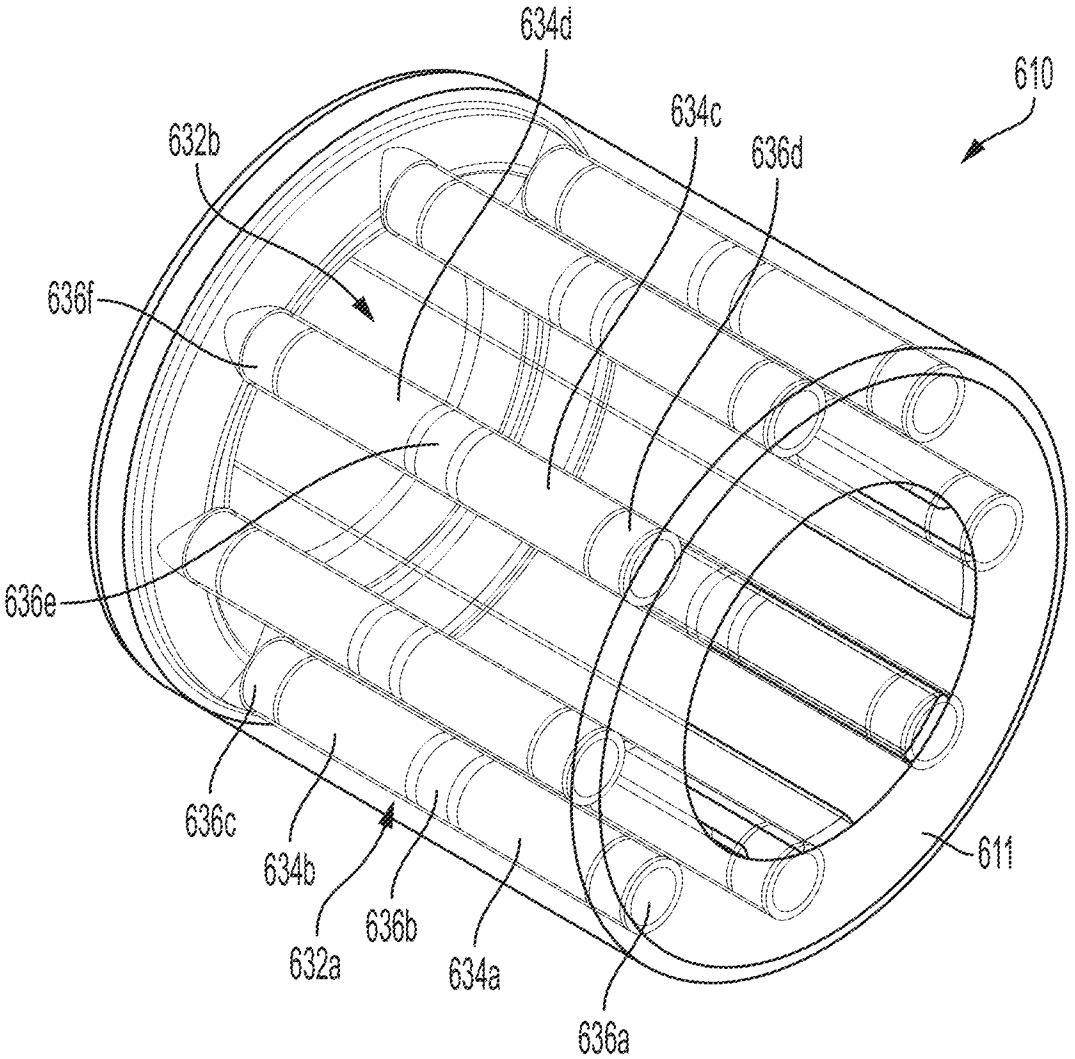
FIG. 6 is a perspective view of a valve magnet assembly containing multiple circumferential magnets according to some examples of the present disclosure.

FIG. 6 is a perspective view of a valve magnet assembly 610 containing multiple circumferential magnets according to some examples of the present disclosure. The valve magnet assembly 610 can include a housing 611 in which a set of magnets is positioned. The set of magnets can include one or more subsets of magnets 632. As illustrated in FIG. 6, the valve magnet assembly 610 includes eight subsets of magnets 632.

In some examples, each subset of magnets 632 can include at least one magnet 634 and at least one flux spacer 636. A number of magnets 634 and flux spacers 636 may vary depending on a desired magnetic field strength. For example, each subset of magnets 632 in FIG. 6 includes two magnets 634 positioned between three flux spacers 636. As a particular example, the subset of magnets 632*a* is arranged such that magnet 634*a* is positioned between flux spacer 636*a* and flux spacer 636*b*, and magnet 634*b* is positioned between flux spacer 636*b* and flux spacer 636*c*. In addition, the subset of magnets 632*b* is arranged such that magnet 634*c* is positioned between flux spacer 636*d* and flux spacer 636*e*, and magnet 634*d* is positioned between flux spacer 636*e* and flux spacer 636*f*. Each of the other six subsets of magnets in the valve magnet assembly 610 may have a similar or different arrangement of magnets 634 and flux spacers 636.

Figure 7:
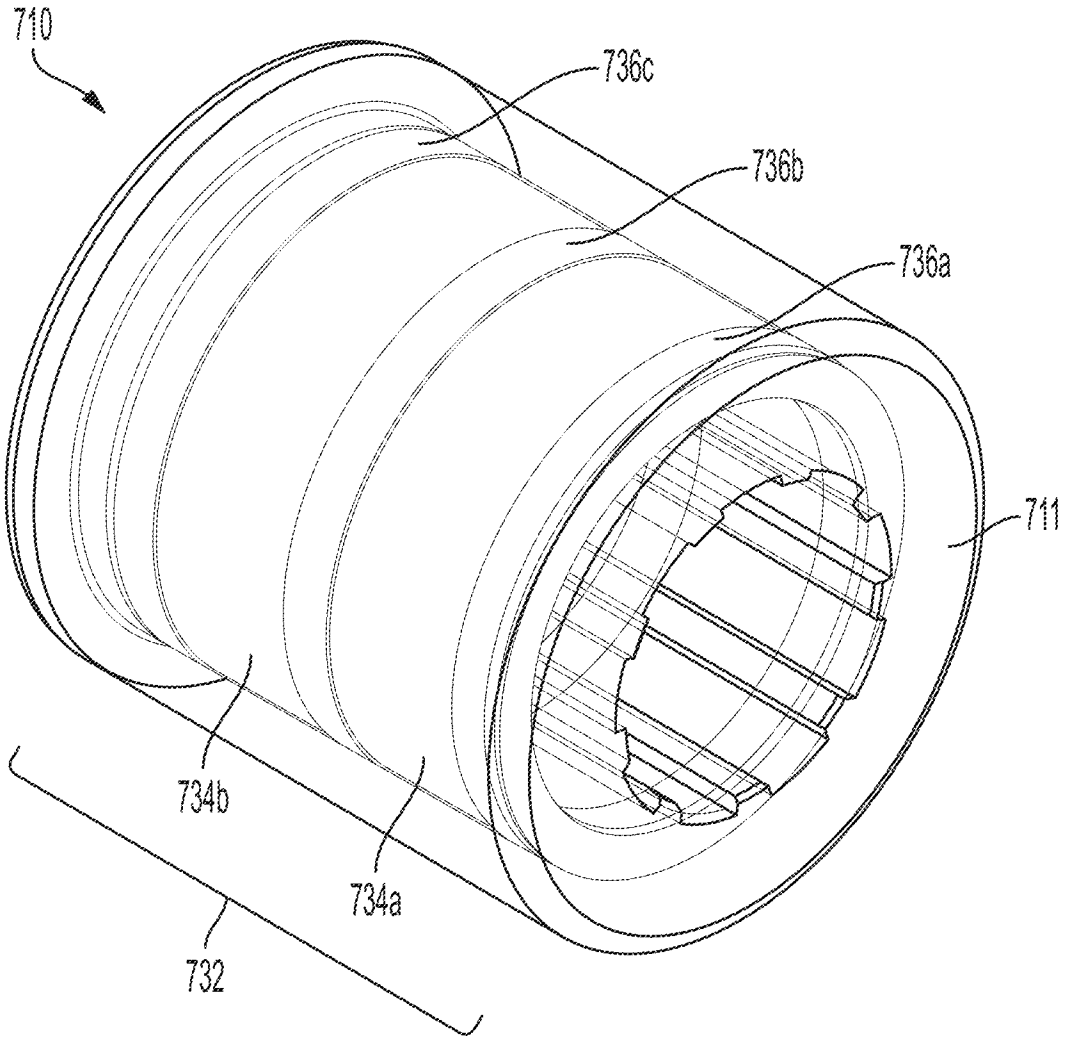
FIG. 7 is a perspective view of a valve magnet assembly containing a single circumferential magnet according to some examples of the present disclosure.

FIG. 7 is a perspective view of a valve magnet assembly 710 containing a single circumferential magnet according to some examples of the present disclosure. The valve magnet assembly 710 can include a housing 711 in which a set of magnets is positioned. The set of magnets can include one or more subsets of magnets 732. As illustrated in FIG. 7, the valve magnet assembly 710 includes one subset of magnets 732.

In some examples, the subset of magnets 732 can include at least one magnet 734 and at least one flux spacer 736. A number of magnets 734 and flux spacers 736 may vary depending on a desired magnetic field strength. For example, the subset of magnets 732 in FIG. 7 includes two magnets 734 positioned between three flux spacers 736. As a particular example, the subset of magnet 732 is arranged such that magnet 734*a* is positioned between flux spacer 736*a* and flux spacer 736*b*, and magnet 734*b* is positioned between flux spacer 736*b* and flux spacer 736*c*.

Figure 8:
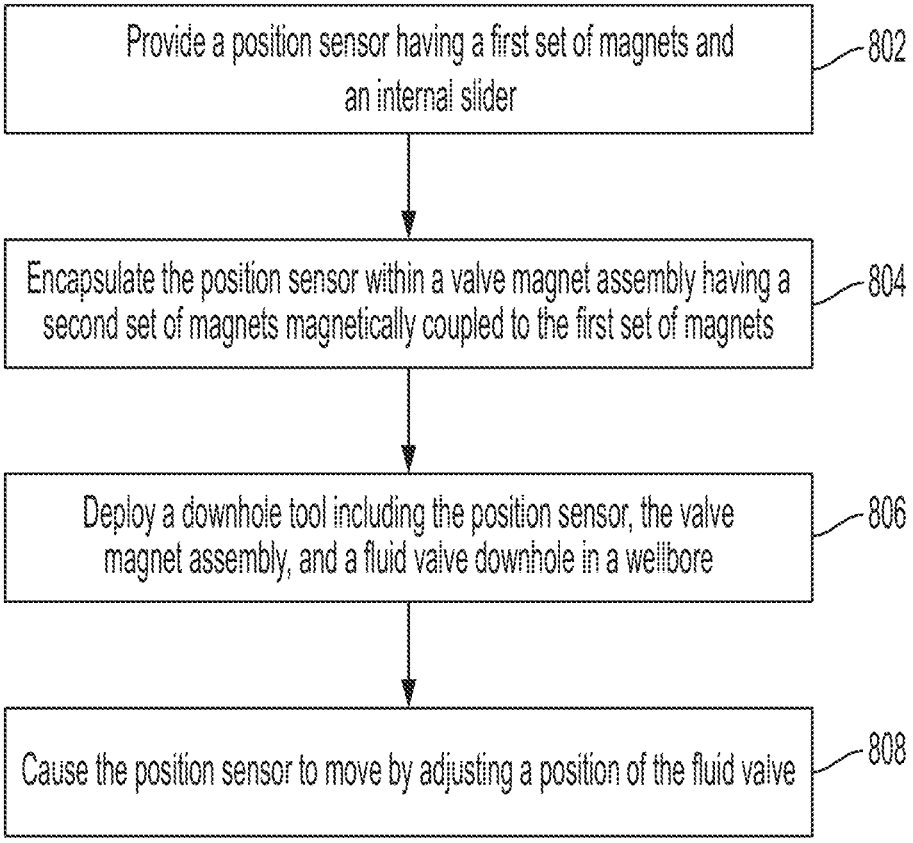
FIG. 8 is a flowchart of an example of a process for using a position sensor assembly with circumferential magnetic coupling for wellbore operations according to some examples of the present disclosure.

FIG. 8 is a flowchart of an example of a process for using a position sensor assembly with circumferential magnetic coupling for wellbore operations according to some examples of the present disclosure. FIG. 8 is described with respect to the components of FIG. 2.

At block 802, a position sensor 220 having a first set of magnets 222 and an internal slider 221 is provided. The first set of magnets 222 can include at least a first magnet having a first pole axis. In some examples, the first set of magnets 222 may include one or more magnets. The position sensor 220 can also include a resistive element 224 and at least one contact 226 having at least one finger 228 for contacting the resistive element 224.

At block 804, the position sensor 220 is encapsulated within a valve magnet assembly 210 having a second set of magnets 212 magnetically coupled to the first set of magnets 222. The second set of magnets 212 can be positioned circumferentially around an outer diameter of the position sensor 220. The second set of magnets 212 can include at least a second magnet having a second pole axis. The first pole axis may be aligned with or perpendicular to the second pole axis. In addition, the second set of magnets 212 can include at least one subset of magnets. Each subset of the at least one subset of magnets can include at least one magnet and at least one flux spacer.

At block 806, a downhole tool 109 including the position sensor 220, the valve magnet assembly 210, and a fluid valve is deployed downhole in a wellbore. The fluid valve may be the fluid valve 105 in FIG. 1. A position of the fluid valve can be adjusted to control an amount of fluid produced from the wellbore. The downhole tool 109 may be deployed as part of a completion operation prior to the wellbore producing fluid.

At block 808, the position sensor 220 is caused to move by adjusting a position of the fluid valve. The fluid valve can be coupled to a mandrel 203 that is coupled to a bracket 202 that is also coupled to a slider 204. The slider 204 can be coupled to the valve magnet assembly 210. Causing the position sensor 220 to move can involve adjusting the position of the fluid valve, moving the mandrel 202 in response to adjusting the position of the fluid valve, moving the slider 204 in response to moving the mandrel 202, moving the valve magnet assembly 210 in response to moving the slider 204, and moving the position sensor 220 in response to moving the valve magnet assembly 210. The position sensor 220 can detect the position of the fluid valve. For example, a change in position of the at least one contact 226 relative to the resistive element 224 is indicatable by a resistance change as the at least one finger 228 of the at least one contact 226 displaces across the resistive element 224 in response to movement of the position sensor 220.

In some aspects, a downhole tool, method, and apparatus for a position sensor with circumferential magnetic coupling for wellbore operations are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a downhole tool comprising: a position sensor comprising a first set of magnets and an internal slider; and a valve magnet assembly comprising a second set of magnets magnetically couplable to the first set of magnets, the second set of magnets being positionable circumferentially around an outer diameter of the position sensor, the valve magnet assembly configured to move in response to a fluid valve, and the valve magnet assembly configured to cause the internal slider of the position sensor to move in response to movement of the valve magnet assembly.

Example 2 is the downhole tool of example 1, further comprising: the fluid valve for controlling an amount of fluid production from a wellbore, the fluid valve comprising: a mandrel couplable to the fluid valve, wherein the mandrel is configured to move in response to adjustments to the fluid valve; a bracket coupleable to the mandrel, wherein the bracket is configured to move in response to movement of the mandrel; and a slider couplable to the bracket and the valve magnet assembly, wherein the slider is configured to move in response to the bracket and is further configured to cause movement of the valve magnet assembly.

Example 3 is the downhole tool of example(s) 1-2, wherein the first set of magnets includes at least a first magnet having a first pole axis, the second set of magnets includes at least a second magnet having a second pole axis, and wherein the first pole axis is aligned with the second pole axis.

Example 4 is the downhole tool of example(s) 1-2, wherein the first set of magnets includes at least a first magnet having a first pole axis, the second set of magnets includes at least a second magnet having a second pole axis, and wherein the first pole axis is perpendicular to the second pole axis.

Example 5 is the downhole tool of example(s) 1-4, wherein the second set of magnets comprises at least one subset of magnets, each subset of the at least one subset of magnets including at least one magnet and at least one flux spacer.

Example 6 is the downhole tool of example 5, wherein the at least one subset of magnets comprises five subsets of magnets distributable circumferentially around the outer diameter of the position sensor or eight subsets of magnets distributable circumferentially around the outer diameter of the position sensor.

Example 7 is the downhole tool of example 5, wherein the at least one subset of magnets comprises one subset of magnets embedded in a housing and positionable circumferentially around an entirety of the outer diameter of the position sensor.

Example 8 is the downhole tool of example(s) 1-7, wherein the position sensor further comprises: a resistive element; and at least one contact comprising at least one finger for contacting the resistive element, wherein a change in position of the at least one contact relative to the resistive element is indicatable by a resistance change as the at least one finger of the at least one contact displaces across the resistive element in response to movement of the internal slider.

Example 9 is a method comprising: providing a position sensor having a first set of magnets and an internal slider; and encapsulating the position sensor within a valve magnet assembly having a second set of magnets magnetically coupled to the first set of magnets, the second set of magnets positioned circumferentially around an outer diameter of the position sensor; deploying a downhole tool downhole in a wellbore, the downhole tool including the position sensor, the valve magnet assembly, and a fluid valve coupled to the valve magnet assembly; and causing the internal slider of the position sensor to move by adjusting a position of the fluid valve.

Example 10 is the method of example 9, wherein the fluid valve is coupled to a mandrel, the mandrel is coupled to a bracket, and the bracket is coupled to a slider, wherein the slider is coupled to the valve magnet assembly, and wherein causing the internal slider of the position sensor to move comprises: adjusting the position of the fluid valve; moving the mandrel in response to adjusting the position of the fluid valve; moving the bracket in response to moving the mandrel; moving the slider in response to moving the bracket; moving the valve magnet assembly in response to moving the slider; and moving the internal slider of the position sensor in response to moving the valve magnet assembly.

Example 11 is the method of example(s) 9-10, further comprising: detecting the position of the fluid valve using the position sensor.

Example 12 is the method of example 11, wherein the position sensor includes a resistive element and at least one contact comprising at least one finger for contacting the resistive element, wherein detecting the position of the fluid valve comprises: detecting a change in position of the at least one contact relative to the resistive element based on a resistance change as the at least one finger of the at least one contact displaces across the resistive element in response to movement of the internal slider.

Example 13 is the method of example(s) 9-12, wherein the first set of magnets includes at least a first magnet having a first pole axis, the second set of magnets includes at least a second magnet having a second pole axis, and wherein the first pole axis is aligned with the second pole axis.

Example 14 is the method of example(s) 9-12, wherein the first set of magnets includes at least a first magnet having a first pole axis, the second set of magnets includes at least a second magnet having a second pole axis, and wherein the first pole axis is perpendicular to the second pole axis.

Example 15 is the method of example(s) 9-14, wherein the second set of magnets comprises at least one subset of magnets, each subset of the at least one subset of magnets including at least one magnet and at least one flux spacer.

Example 16 is an apparatus comprising: a position sensor of a downhole tool, the position sensor comprising a first set of magnets and an internal slider positionable within a first housing; and a valve magnet assembly of the downhole tool, the valve magnet assembly comprising: a second housing surrounding an outer diameter of the first housing; and a second set of magnets magnetically couplable to the first set of magnets, the second set of magnets being positionable within the second housing, the internal slider of the position sensor configured to move in response to movement of the valve magnet assembly.

Example 17 is the apparatus of example 16, wherein the second set of magnets comprises at least one subset of magnets, each subset of the at least one subset of magnets including at least one magnet and at least one flux spacer.

Example 18 is the downhole tool of example 17, wherein the at least one subset of magnets comprises five subsets of magnets distributable circumferentially around the outer diameter of the position sensor or eight subsets of magnets distributable circumferentially around the outer diameter of the position sensor.

Example 19 is the apparatus of example(s) 16-18, wherein the first set of magnets includes at least a first magnet having a first pole axis, the second set of magnets includes at least a second magnet having a second pole axis, and wherein the first pole axis is aligned with the second pole axis.

Example 20 is the apparatus of example(s) 16-19, wherein the position sensor further comprises: a resistive element; and at least one contact comprising at least one finger for contacting the resistive element, wherein a change in position of the at least one contact relative to the resistive element is indicatable by a resistance change as the at least one finger of the at least one contact displaces across the resistive element in response to movement of the internal slider.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A downhole tool comprising:

a position sensor comprising a first set of magnets and an internal slider;

a valve magnet assembly comprising a second set of magnets magnetically couplable to the first set of magnets, the second set of magnets being positionable circumferentially around an outer diameter of the position sensor, the valve magnet assembly configured to move in response to a fluid valve, and the valve magnet assembly configured to cause the internal slider of the position sensor to move in response to movement of the valve magnet assembly, wherein the second set of magnets is embedded in a housing and positionable circumferentially at least at opposing sides of the outer diameter of the position sensor relative to a central longitudinal axis of the housing;

the fluid valve for controlling an amount of fluid production from a wellbore;

a mandrel couplable to the fluid valve, wherein the mandrel is configured to move in response to adjustments to the fluid valve;

a bracket couplable to the mandrel, wherein the bracket is configured to move in response to movement of the mandrel; and a slider couplable to the bracket and the valve magnet assembly, wherein the slider is configured to move in response to the bracket and is further configured to cause movement of the valve magnet assembly, and wherein the slider is configured to move radially relative to the bracket.

2. The downhole tool of claim 1, wherein the first set of magnets includes at least a first magnet having a first pole axis, the second set of magnets includes at least a second magnet having a second pole axis, and wherein the first pole axis is aligned with the second pole axis.

3. The downhole tool of claim 1, wherein the first set of magnets includes at least a first magnet having a first pole axis, the second set of magnets includes at least a second magnet having a second pole axis, and wherein the first pole axis is perpendicular to the second pole axis.

4. The downhole tool of claim 1, wherein the second set of magnets comprises at least one subset of magnets, each subset of the at least one subset of magnets including at least one magnet and at least one flux spacer.

5. The downhole tool of claim 4, wherein the at least one subset of magnets comprises five subsets of magnets distributable circumferentially around the outer diameter of the position sensor or eight subsets of magnets distributable circumferentially around the outer diameter of the position sensor.

6. The downhole tool of claim 4, wherein the at least one subset of magnets comprises one subset of magnets embedded in the housing and positionable circumferentially around an entirety of the outer diameter of the position sensor.

7. The downhole tool of claim 1, wherein the position sensor further comprises:

a resistive element; and at least one contact comprising at least one finger for contacting the resistive element, wherein a change in position of the at least one contact relative to the resistive element is indicatable by a resistance change as the at least one finger of the at least one contact displaces across the resistive element in response to movement of the internal slider.

8. A method comprising:

providing a position sensor having a first set of magnets and an internal slider; and encapsulating the position sensor within a valve magnet assembly having a second set of magnets magnetically coupled to the first set of magnets, the second set of magnets positioned circumferentially around an outer diameter of the position sensor, wherein the second set of magnets is embedded in a housing and positionable circumferentially at least at opposing sides of the outer diameter of the position sensor relative to a central longitudinal axis of the housing;

deploying a downhole tool downhole in a wellbore, the downhole tool including the position sensor, the valve magnet assembly, and a fluid valve coupled to the valve magnet assembly; and causing the internal slider of the position sensor to move by adjusting a position of the fluid valve;

wherein the downhole tool further comprises:

the fluid valve for controlling an amount of fluid production from the wellbore;

a mandrel couplable to the fluid valve, wherein the mandrel is configured to move in response to adjustments to the fluid valve;

a bracket couplable to the mandrel, wherein the bracket is configured to move in response to movement of the mandrel; and a slider couplable to the bracket and the valve magnet assembly, wherein the slider is configured to move in response to the bracket and is further configured to cause movement of the valve magnet assembly, and wherein the slider is configured to move radially relative to the bracket.

9. The method of claim 8, wherein causing the internal slider of the position sensor to move comprises:

adjusting the position of the fluid valve;

moving the mandrel in response to adjusting the position of the fluid valve;

moving the bracket in response to moving the mandrel;

moving the slider in response to moving the bracket;

moving the valve magnet assembly in response to moving the slider; and moving the internal slider of the position sensor in response to moving the valve magnet assembly.

10. The method of claim 8, further comprising:

detecting the position of the fluid valve using the position sensor.

11. The method of claim 10, wherein the position sensor includes a resistive element and at least one contact comprising at least one finger for contacting the resistive element, wherein detecting the position of the fluid valve comprises:

detecting a change in position of the at least one contact relative to the resistive element based on a resistance change as the at least one finger of the at least one contact displaces across the resistive element in response to movement of the internal slider.

12. The method of claim 8, wherein the first set of magnets includes at least a first magnet having a first pole axis, the second set of magnets includes at least a second magnet having a second pole axis, and wherein the first pole axis is aligned with the second pole axis.

13. The method of claim 8, wherein the first set of magnets includes at least a first magnet having a first pole axis, the second set of magnets includes at least a second magnet having a second pole axis, and wherein the first pole axis is perpendicular to the second pole axis.

14. The method of claim 8, wherein the second set of magnets comprises at least one subset of magnets, each subset of the at least one subset of magnets including at least one magnet and at least one flux spacer.

15. An apparatus comprising:

a position sensor of a downhole tool, the position sensor comprising a first set of magnets and an internal slider positionable within a first housing;

a valve magnet assembly of the downhole tool, the valve magnet assembly comprising:

a second housing surrounding an outer diameter of the first housing; and a second set of magnets magnetically couplable to the first set of magnets, the second set of magnets being embedded in the second housing and positionable circumferentially at least at opposing sides of the outer diameter of the position sensor relative to a central longitudinal axis of the second housing, the internal slider of the position sensor configured to move in response to movement of the valve magnet assembly; and the downhole tool further comprising:

a fluid valve for controlling an amount of fluid production from a wellbore;

a mandrel couplable to the fluid valve, wherein the mandrel is configured to move in response to adjustments to the fluid valve;

a bracket couplable to the mandrel, wherein the bracket is configured to move in response to movement of the mandrel; and a slider couplable to the bracket and the valve magnet assembly, wherein the slider is configured to move in response to the bracket and is further configured to cause movement of the valve magnet assembly, and wherein the slider is configured to move radially relative to the bracket.

16. The apparatus of claim 15, wherein the second set of magnets comprises at least one subset of magnets, each subset of the at least one subset of magnets including at least one magnet and at least one flux spacer.

17. The downhole tool of claim 16, wherein the at least one subset of magnets comprises five subsets of magnets distributable circumferentially around the outer diameter of the position sensor or eight subsets of magnets distributable circumferentially around the outer diameter of the position sensor.

18. The apparatus of claim 15, wherein the first set of magnets includes at least a first magnet having a first pole axis, the second set of magnets includes at least a second magnet having a second pole axis, and wherein the first pole axis is aligned with the second pole axis.

19. The apparatus of claim 15, wherein the position sensor further comprises:

a resistive element; and at least one contact comprising at least one finger for contacting the resistive element, wherein a change in position of the at least one contact relative to the resistive element is indicatable by a resistance change as the at least one finger of the at least one contact displaces across the resistive element in response to movement of the internal slider.

* * * * *